US005165742A

United States Patent [19]

Frayne

[11] Patent Number: 5,165,742

[45] Date of Patent: Nov. 24, 1992

[54] VEHICLE WINDOW LATCH EXTENDER

[76] Inventor: Clifford G. Frayne, 22 Tamany Ct., Brick Town, N.J. 08723

[21] Appl. No.: 828,501

[22] Filed: Jan. 31, 1992

[51] Int. Cl.[5] ..... E04C 19/18; E04C 17/30

[52] U.S. Cl. ..... 292/262; 292/276; 292/DIG. 43

[58] Field of Search ..... 292/DIG. 43, 276, 262, 292/339, 288, 341.13, 341.18

[56] References Cited

U.S. PATENT DOCUMENTS

| | | | |
|---|---|---|---|
| 1,447,846 | 3/1923 | Hill | 292/262 |
| 2,199,369 | 4/1940 | Bernstein | 292/288 |
| 2,263,065 | 11/1941 | Baldauf | 292/DIG. 43 |
| 2,504,367 | 4/1950 | Willink | 292/278 |
| 2,618,497 | 11/1952 | Gardeis | 292/265 |
| 2,684,265 | 7/1954 | Ceresa | 296/76 |
| 2,742,312 | 4/1956 | Oswald | 292/241 |
| 2,916,176 | 12/1958 | Widmer | 292/262 |
| 3,195,940 | 7/1963 | Woodling | 292/262 |
| 4,070,050 | 1/1978 | Glock et al. | 292/339 |
| 4,278,280 | 7/1981 | Rashbaum | 292/263 |
| 4,307,907 | 12/1981 | Barrowman et al. | 292/DIG. 43 |
| 4,322,103 | 3/1982 | Acton | 292/288 |
| 4,593,946 | 6/1986 | Rich | 292/262 |
| 4,609,216 | 9/1986 | Baker et al. | 292/262 |
| 4,667,993 | 5/1987 | Hannesson et al. | 292/339 |
| 5,035,449 | 7/1991 | Shiratori et al. | 292/DIG. 43 |

FOREIGN PATENT DOCUMENTS

| | | | |
|---|---|---|---|
| 3435603 | 4/1986 | Fed. Rep. of Germany | 292/262 |

*Primary Examiner*—Eric K. Nicholson
*Attorney, Agent, or Firm*—Clifford G. Frayne

[57] ABSTRACT

A latch extender for a pivotal window assembly of a vehicle in which the pivotal window assembly includes a latch member for engaging the locking mechanism of the door of the vehicle, the latch extender being rigidly affixed to the latch member of the pivotal window assembly, the latch extender having a hasp substantially identical to the latch member of the pivotal window assembly, the hasp of the latch extender engaging the locking mechanism of the door assembly so as to secure the pivotal window assembly in a locked, yet opened position to permit cross ventilation within the vehicle while operating.

2 Claims, 3 Drawing Sheets

VEHICLE WINDOW LATCH EXTENDER

FIELD OF INVENTION

The present invention relates to window latches and, particular, to window latches for the rear window of sport utility vehicles in which the window is pivotly secured along its upper edge and the door portion is pivotly secured along its lower edge such that the window and the door engage in locking cooperation to seal the rear of the vehicle.

BACKGROUND OF THE INVENTION

Utility vehicles have become increasingly popular means of transportation The vehicle is a hybrid between a pickup truck and a station wagon and is designed to carry four or more people and permit storage of luggage, equipment or the like behind the rear seat. The rear seat is normally foldable downwardly to permit two passengers and increased luggage or equipment to be carried. The vehicles are normally constructed with a passenger side and driver side door and in some instances, two additional doors to allow direct access to the rear seat.

In most instances, access to the rear storage area is through a two-piece rear door. The top half of the rear door is comprised of the rear window and frame with the lower half of the rear door being of solid construction. The window portion of the rear door is normally hingeably secured to the roof of, the vehicle along the window frame upper edge. The solid construction lower half portion of the rear door is hingeably secured proximate to the rear bumper to permit the lower portion of the rear door to pivot downwardly. In securing the rear of the vehicle, the lower portion of the door is normally secured in upright locked position first, and then the upper window portion is pivoted downwardly having a central latch plate hasp for locking engagement with a locking means in the lower door portion. The upper window portion of the rear door is normally secured to piston supports on the lateral edges which will hold the window in an upright position when open so as not to interfere with access to the rear cargo area.

A problem oftentimes arises with respect to the operation of the aforesaid vehicles in that it is not possible to obtain any cross ventilation while operating the vehicle since the rear window is in a locked position. It is not advisable to operate the vehicle with the rear window in a totally upright position in that airflow around the vehicle and bumps encountered by the vehicle may damage the window supports. Additionally, operating the vehicle with the window in its upright open position could lead to the loss of luggage, equipment or the like stored in the storage area. Operating the vehicle with the passenger side window or driver's side window slightly open will provide some ventilation, but is not sufficient to remove cigarette smoke or the like, and oftentimes disrupts or interferes with the desired temperature that the operator wishes to maintain within the vehicle.

The present invention is directed to a mechanism which easily mounted on the existing latch of the rear window of such a vehicle which allows the rear window to be lowered and engaged, with the locking mechanism of the lower portion of the door to secure the window in a locked mode yet still provide for a passageway between the upper window portion of the rear door and the lower solid portion of the rear door such that airflow and ventilation within the vehicle will flow rearwardly and exit through this passageway, the passageway being of such a dimension that luggage, equipment or the like stored behind the rear seat cannot exit the vehicle.

OBJECTS OF THE INVENTION

It is a principal object of the present invention to provide a window latch extender for the rear window of a sport utility vehicle in which the window pivots upwardly, the latch extender being secured to the existing latch and permitting the window to be engaged in a locked position, yet maintaining a gap between the window and the lower door portion.

A further object of the present invention is to provide a window latch extender which permits cross ventilation within the vehicle when driven.

A further object of the present invention is to provide a window latch extender which secures the rear, partially-opened window in a locked position.

A still further object of the present invention is to provide for a window latch extender which secures the rear window in an opened, yet locked position in a secure manner as to prevent damage to the window.

Other objects and advantages of the invention will become apparent to those skilled in the art from a review of ensuing description.

SUMMARY OF THE INVENTION

In accordance with the present invention, a window latch extender having a lock engaging means, the lock engaging means secured to a body member which is securable to the window latch affixed to the rear, pivotal window of a vehicle, the lock engaging means securable in the locking mechanism positioned in the lower portion of the rear door so as to maintain the rear, pivotal window in a slightly opened, yet locked position.

BRIEF DESCRIPTION OF THE DRAWINGS

A better understanding of the present invention as well as other objects and inventions thereof will become apparent on consideration of the detailed disclosure thereof especially when taken with the accompanying drawings wherein.

DETAILED DESCRIPTION OF THE DRAWINGS

Figure 1:
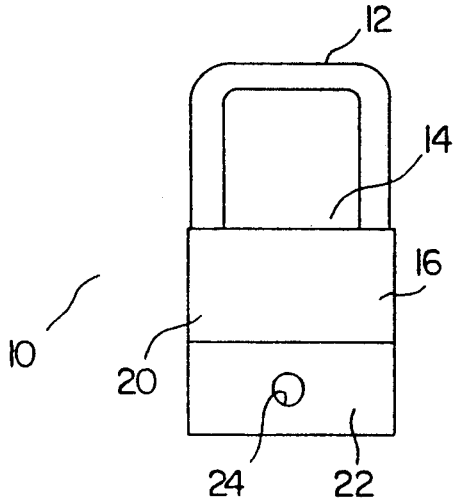
FIG. 1 is a front plan view of the window latch extender.
Figure 2:
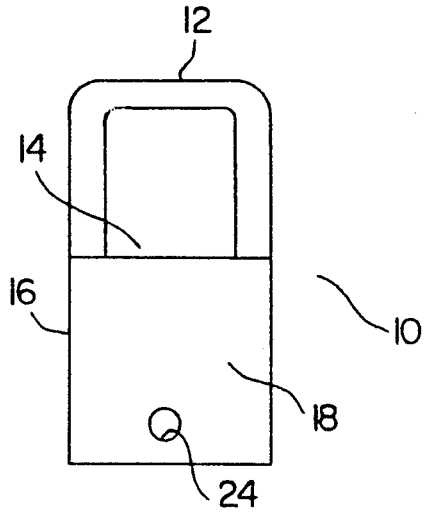
FIG. 2 is a rear plan view of the window latch extender.

FIG. 1 and FIG. 2, respectively, illustrate a front plan view and rear plan view of the window latch extender 10. In the preferred embodiment, the window latch extender 10 has a lock engaging hasp member 12 which is generally U-shaped and circular in cross sectional area. Lock engaging hasp member 12 is substantially identical in size to the lock engaging member affixed to the inside of the rear window of a sport utility vehicle as described hereafter. Lock engaging hasp member 12 is secured at its opened end 14 to a body member 16. In the embodiment illustrated in FIGS. 1 and 2, body member 16 has a rear planer surface 18 and a stepped front surface 20, the recessed surface 22 of stepped surface 20 having positioned therethrough an aperture 24 for receipt of a securing means. In the preferred embodiment, aperture 24 would be internally threaded for receipt of the securing means.

Figure 3:
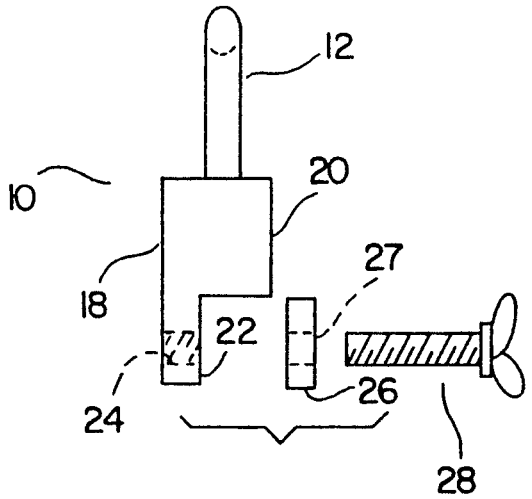
FIG. 3 is a side view of the window latch extender assembly.

Referring to FIG. 3, there is illustrated a side view of the latch extender 10 and its additional components. The additional components of window latch extender comprise a facing plate 26, the dimensions of which are substantially complimentary and identical to the dimension of recess surface 22 on stepped surface 20 of body member 16. Facing plate 26 has an aperture 27 positioned therethrough which is in alignment with aperture 24 in recessed surface 22 when facing plate 26 is positioned complimentary to recessed surface 22.

The securing means utilized in the preferred embodiment comprises a threaded wing bolt 28 which passes through aperture 27 in facing plate 26 and is threadedly secured in aperture 24 in recessed surface 22. A channel 30 is created between facing plate 26 and recessed surface 22 for receipt of the window hasp which is permanently affixed to the rear window of the vehicle as will be described with reference to FIGS. 5 and 6.

Figure 4:
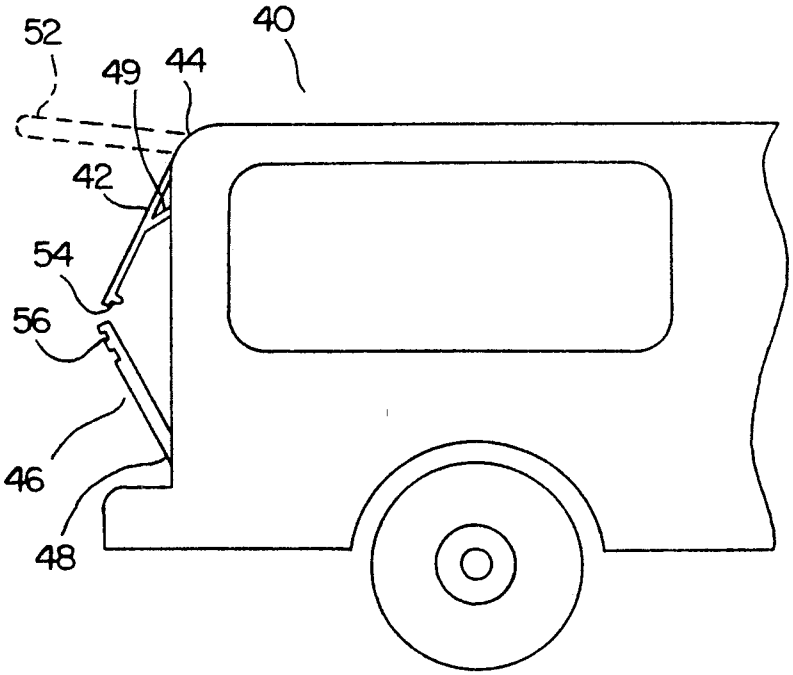
FIG. 4 is a partial side view of a utility vehicle to which the latch extender has application.

FIG. 4 is a partial side view of the rear of a vehicle to which window latch extender 10 would have application. The vehicle 40 has a rear entranceway to the storage compartment comprised of a two-piece door. The upper portion 42 of the door is comprised of a rear window enclosed in a frame and hingeably secured to the vehicle along its uppermost edge 44. The lower portion of the door is comprised of a solid section 46 which is hingeably secured to the vehicle along its lower edge 48. Upper portion 42 of the rear door may normally have two piston-type supports 49 secured to the window frame edges and secured internally to the vehicle such that upper portion 42 can be opened and maintained in a substantially-horizontal position 52 for access to the rear portion of the vehicle. Lower door portion 46 is operable from the closed position to a substantially-horizontal open position to aid in access to the rear portion of the vehicle. When enclosing or securing the rear of the vehicle, lower portion 46 is first raised to a substantially vertical position where it lockingly engages the frame of the vehicle. The upper window portion 42 is then manually lowered such that hasp 54 positioned on the lower portion of the frame of upper portion 42 engages locking mechanism 56 within lower portion 46, thus securing the rear of the vehicle.

The reverse process occurs in opening the rear of the vehicle with the operator inserting a key into the lock on the lower portion of the rear door which releases locking mechanism 56 and allows upper portion 42 to be rotated to a substantially-horizontal position 52. Lower portion 46 at the option of the operator can then be disengaged and lowered to a horizontal position. The piston-type supports 49 secured to upper portion 42 are designed to maintain the upper window portion 42 in all horizontal position for access to the rear of the storage area, but do not have any capability for lockingly engaging the upper window portion 42 in any specific location.

Figure 6:
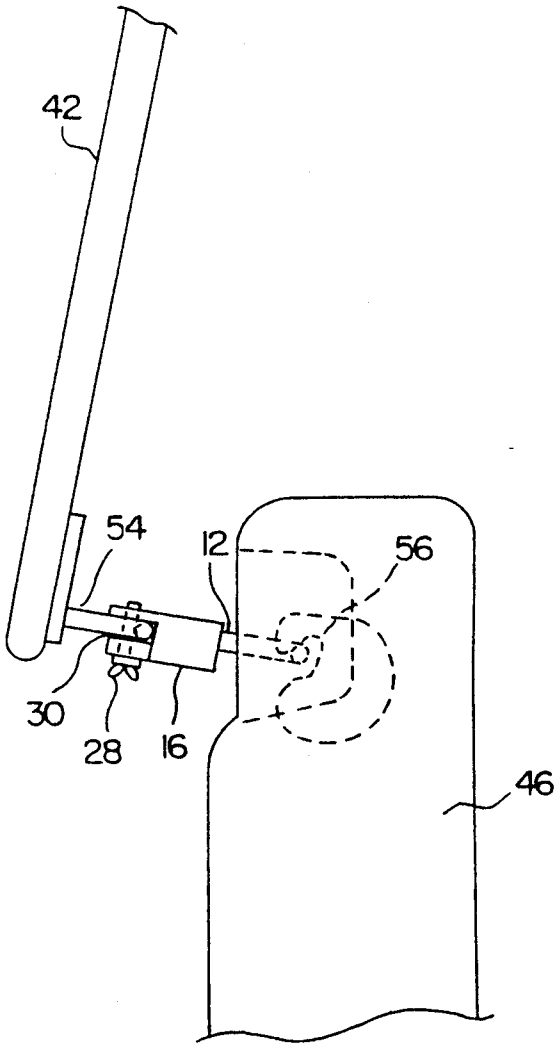
FIG. 6 is a detailed side view of the latch extender securing the rear window of the vehicle in an opened and locked position.
Figure 5:
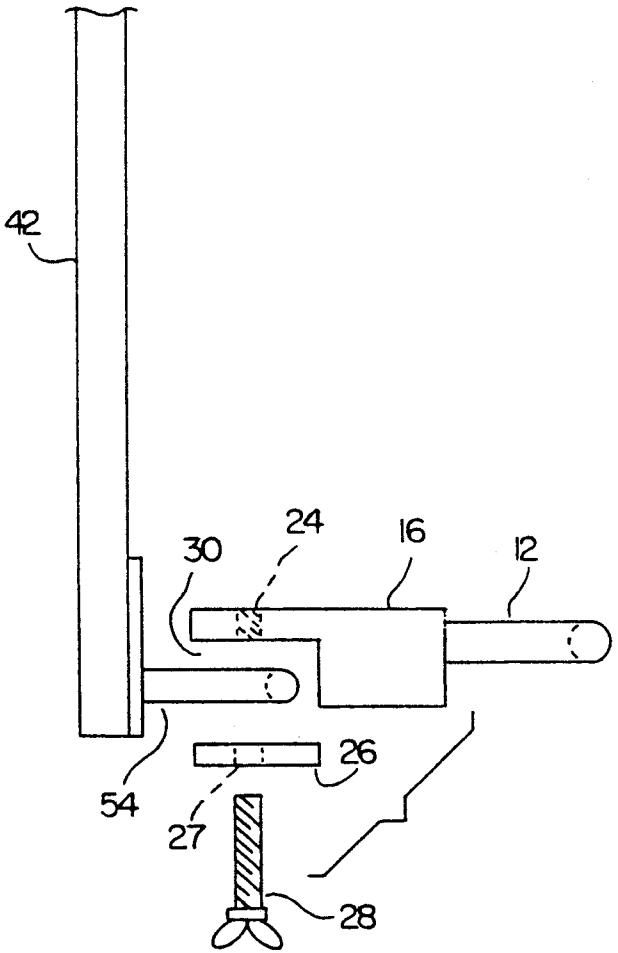
FIG. 5 is a partial, side, exploded view illustrating the assembly of the latch extender.

FIG. 5 illustrates the window latch extender assembly 10 being secured to hasp 54 of upper window portion 42. FIG. 6 illustrates the manner in which the window latch extender assembly 10 then engages the locking mechanism 56 in the lower portion 46 of the rear door thus establishing the upper window portion 42 in a locked, yet opened position.

If the individual wished to create cross ventilation within the vehicle, the individual would engage lower door portion 46 in its closed position and open upper window portion 42. Body member 16 of window latch extender 10 and facing plate 26 would then be positioned about window hasp 54 such that wing bolt 28 would pass through aperture 27 in facing plate 26 and threadedly engage aperture 24 in body member 16. Window hasp 54 is thus positioned in channel 30 between recessed surface 22 and facing plate 26, in locking engagement with window latch extender 10 such that lock engaging hasp member 12 of window latch extender 10 is positioned to engage locking mechanism 56 in door 46 when window 42 is pivoted towards a closed, locked position. Window 42 therefore becomes locked in engagement with door 46, however, a gap exists between window 42 and door 46, such gap approximately equal to the length of lock engaging hasp member 12 of window latch extender 10 as illustrated in FIG. 6. This gap provides for the cross ventilation of the vehicle while in operation by allowing vented air entering the front of the vehicle either by means of a slight opening of the window or the opening of the internal vents of the vehicle to flow rearwardly and exit the vehicle through the gap between the window and the door. The gap is not sufficient to allow personal belongings or other items to exit the vehicle, yet does permit the cross ventilation and does secure the window in a locked position.

Figure 7:
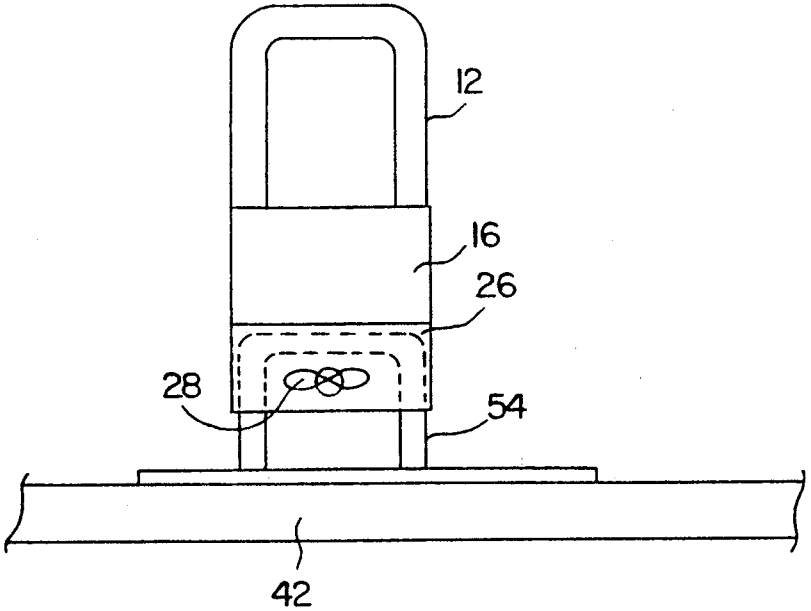
FIG. 7 is a bottom plan view illustrating the latch extender secured to the window hasp.

FIG. 7 is a plan view viewed from below window portion 42 illustrating the actual positioning of window hasp 54 in window latch extender assembly 10. Window hasp 54 is positioned between body member 16 and facing plate 26 and maintained in such position by means of threaded wing bolt 28. In the embodiment as disclosed, the width of body member 16 and facing plate 26 is such that it overlaps the parallel legs of window hasp 54. This construction prevents any rotation of window latch extender 10 about the crossover leg of window hasp 54. In this configuration, window latch extender 10 provides for a rigid connection between upper window portion 42 and locking mechanism 56 in lower door portion 46.

The use of a stepped surface 20 on body member 16 in cooperation with facing plate 26 allows for window latch extender assembly to accommodate window hasps 54 of slightly different diameters. Threaded wing bolt 28 would be threadedly secured through facing plate 26 and body member 16 to ensure a secure coupling. Facing plate 26 could be rigidly secured to body member 16 similar to recess surface 22 to form a yoke assembly which could be slipped over window hasp 54 and secured, however, such a configuration may not be able to accommodate window hasps of varying diameter.

The object of this invention is to provide for a slight gap between the upper pivotal section of a two-piece door and the lower pivotal section of a two-piece door commonly found on vehicles. The gap distance would provide for cross ventilation within the vehicle when the vehicle was operating. Since this gap distance does not have to be significant in order to achieve the cross ventilation, the engaging hasp member 12 on latch extender 10 when secured to window hasp 54 is substantially parallel to window hasp 54. This allows for engaging hasp member 12 to be positioned in locking engagement with locking means 56 in door 46 so as to maintain the gap between lower door portion 46 and upper window portion 42, yet still maintain upper window portion 42 in a locked mode with respect to lower door portion 46. If larger gaps between lower door portion 46 and upper window portion 42 were desired, the length of engaging hasp member 12 could be extended, but in such instances, depending upon the length of the distance of the gap desired, engaging hasp member 12 may have to be slightly arcuate in shape and therefore not parallel with window hasp 54 in order that it can engage locking means 56.

In order to achieve the cross ventilation provided by window latch extender 10, it has been found experimentally that the gap between upper window portion 42 and lower door portion 46 can be as little as a ½ inch, but is preferably in the range of 1 inch to 2 inches. Again, it is a matter of choice depending upon the length of engaging hasp member 12.

The removal of window latch extender assembly 10 is accomplished by inserting the key into the lock in the lower door portion 46 of the vehicle, and disengaging locking means 56 from engaging hasp member 12. Upper window portion 42 can then be pivoted upwardly to allow the operator to remove threaded wing bolt 28 and the window latch extender assembly. Upper window portion 42 can then be pivoted downwardly such that window hasp member 54 engages locking mechanism 56 and the rear of the vehicle is completely sealed.

While the invention has been described with reference to its preferred embodiment thereof, it will be appreciated by those of ordinary skill in the art that various changes can be made in the process and apparatus without departing from the basic spirit and scope of the invention.

I claim:

1. A latch extender for a pivotal window assembly of a vehicle for securing said window in a partially-opened, locked position, wherein said pivotal window assembly includes a latch member for engaging a locking mechanism of the vehicle, said latch extender comprising:

a body member having a hasp portion for engaging said locking mechanism of said vehicle and a latch portion for engaging said latch member of said pivotal window assembly, said hasp portion of said body member is parallel disposed with respect to said latch member of said pivotal window assembly, said latch portion of said body member is formed with a stepped shoulder portion to receive said latch member of said pivotal window assembly, said latch portion of said latch extender is formed with a threaded orifice therethrough, cooperative with a means for rigidly affixing said latch portion of said body member to said latch member of said pivotal window assembly, said means comprising a plate member having an orifice for receiving a threaded bolt for threading through said threaded orifice of said latch member of said body member for the positioning of said latch member of said pivotal window assembly within said stepped shoulder portion and captured therein by said plate member.

2. A latch extender as defined by claim 1 in which said latch member of said pivotal window assembly is generally U-shaped in configuration having two generally parallel legs and a crossover leg, and said plate member and said latch member engage said crossover leg and portions of said generally parallel legs of said latch member of said pivotal window assembly positioning said threaded orifice of said latch portion of said latch extender and said orifice of said plate member between said generally parallel legs of said latch member of said pivotal window assembly to permit the securing of said threaded bolt through said orifices between said generally parallel leg members and crossover leg member of said latch member of said pivotal window assembly so as to prevent rotation of said latch extender about said crossover leg member of said latch member of said pivotal window assembly.

* * * * *